US006203017B1

(12) United States Patent
Schultz

(10) Patent No.: US 6,203,017 B1
(45) Date of Patent: Mar. 20, 2001

(54) FOLDING BOARD GAME HAVING POP-UP FEATURES

(75) Inventor: Lucy K. Schultz, Redondo Beach, CA (US)

(73) Assignee: Mattel, Inc., El Segundo ( * ) Notice: Subject to any disclaimer, the term of this patent is extended or adjusted under 35 U.S.C. 154(b) by 0 days.

(21) Appl. No.: 09/364,894

(22) Filed: Aug. 2, 1999

(51) Int. Cl.[7] ..... A63F 3/00

(52) U.S. Cl. ..... 273/285; 273/241; 273/236; 273/242; 273/287

(58) Field of Search ..... 273/236, 241, 273/242, 243, 285, 286, 287; 40/539; 446/488, 148

(56) References Cited

U.S. PATENT DOCUMENTS

| | | | |
|---|---|---|---|
| 565,450 | * | 8/1896 | Gibson . |
| 990,918 | * | 5/1911 | Stadler . |
| 1,430,778 | * | 10/1922 | Williams . |
| 1,549,610 | * | 8/1925 | Reisz . |
| 1,819,932 | * | 8/1931 | Walden . |
| 1,870,395 | * | 8/1932 | Zarin . |
| 1,992,618 | | 2/1935 | Jeffreys . |
| 2,221,267 | * | 11/1940 | Robertson . |
| 3,880,429 | * | 4/1975 | Blumenaus . |
| 4,130,284 | * | 12/1978 | Fuks . |
| 4,349,973 | | 9/1982 | Penick et al. . |
| 4,712,673 | * | 12/1987 | Moore . |
| 4,781,384 | * | 11/1988 | Bois . |
| 5,022,681 | | 6/1991 | Penick . |
| 5,049,078 | | 9/1991 | Thomsen . |
| 5,096,204 | | 3/1992 | Lippman . |
| 5,104,124 | | 4/1992 | Bernard et al. . |
| 5,213,507 | | 5/1993 | Ozrovitz . |
| 5,293,706 | | 3/1994 | Wood . |
| 5,356,155 | | 10/1994 | Gross . |
| 5,358,252 | | 10/1994 | McMaul . |
| 5,562,520 | * | 10/1996 | Pridonoff . |
| 5,681,199 | | 10/1997 | Morris . |
| 5,682,999 | * | 11/1997 | Larson . |
| 5,961,149 | * | 10/1999 | Hunt . |

FOREIGN PATENT DOCUMENTS

590416 * 7/1947 (GB) .

* cited by examiner

*Primary Examiner*—Benjamin H. Layno
*Assistant Examiner*—Vishu Mendiratta
(74) *Attorney, Agent, or Firm*—Roy A. Ekstrand

(57) ABSTRACT

A board game includes a folding board having a plurality of generally planar board segments joined to form a large planar play surface by a plurality of hinges. The folding board is configurable in a closed configuration suitable for storage or transport by successively folding the various planar segments in a generally inwardly rolling succession of folds from each end of the board. The board game further includes a generally rectangular box supported at one end of the folding board which may opened and is therefore a convenient storage for loose items such as game play tokens or the like. The folding board is opened to a generally planar playing position by unfolding the segments about their respective hinges. A plurality of pop-up features are secured to the folding board and collapse to facilitate folding and rise when the board is unfolded.

7 Claims, 2 Drawing Sheets

FOLDING BOARD GAME HAVING POP-UP FEATURES

FIELD OF THE INVENTION

This invention relates generally to board games and particularly to the folding board structures used therein.

BACKGROUND OF THE INVENTION

Board games are a very well known and very pervasive type of game and acquire their name from the use of a generally planar often folding board as the basis of the game. While initially board games comprised conventional games such as chess or checkers, in early developments various games which may be generally described as "pathway" type games were developed. Such pathway games have resulted in an even greater popularity and variety of board games. Thus, board games have been provided which utilize a variety of game play rules and themes. Additionally, board games have been provided which utilize a variety of appearances often brightly colored and amusing to improve the attractiveness of the board game.

While the variety of board games that have been provided by practitioners in the art is virtually endless, typically such board games include a generally planar board upon which a plurality of segments or stations are defined. Often the segments or stations are arranged in a travel pathway defining a start and an end station of position. A plurality of tokens or markers are usually provided which allow each player to manipulate their particular element through the game pathway. A variety of game rules controlling the game play together with various so-called "chance" devices such as dice, spinners or decks of instruction baring cards are utilized to control the flow of game play.

For example, U.S. Pat. No. 5,356,155 issued to Gross sets forth a LOOSE LEAF BOUND BOARD GAMES having a board game kit which includes a loose leaf binder having a front panel and a bottom panel and a connecting rib supporting several binders. A plurality of board games are removably held by the binder each of which includes an appendage with an appropriate holds for binder retention.

U.S. Pat. No. 5,358,252 issued to Mc Phaul sets forth a THREE-DIMENSIONAL MULTI-TIERED CHESS BOARD having a generally rectangular chess board defining columns and rows of square spaces. A center group of defined spaces is supported at a substantially lower tier than the outer most border of spaces. Intermediate spacers are supported at intermediate tiers to produce a downwardly stepped succession of tiers between the upper most outer boarder and the lower most center tier.

In another well known art, various books and cards have been provided which utilize combinations of features known generally in the art as "pop-ups". The structure and fabrication of pop-ups are well known in the art and have been provided in a wide variety of structures and operative mechanisms. Whiled varied in structure and type, basically all pop-ups utilize some form of folding cover sheets which enclose the pop-up feature elements. The pop-up elements themselves are often folded between the covers and are either spring loaded to rise when the covers are separated such as the opening of a book or alternatively are coupled to various sliding members which raise and lower the pop-up elements as the book or card is opened or closed.

For example, U.S. Pat. No. 5,022,681 issued to Penick sets forth PAPER POP-UP DEVICES AND METHOD OF MAKING THE SAME for use in a magazine or other publication or for use by itself in applications such as mailers or the like. The device includes two display elements hingedly connected to a front of two covers. The opening of the front cover forces erection of the two display elements and allows the elements to stand up out of the plane thereof.

U.S. Pat. No. 1,992,618 issued to Jeffreys sets forth a BOOK having a plurality of pages hingedly secured to a common binder. Each page supports one or more pop-up features hingedly coupled between facing pages such that opening of the book between any two facing pages raises the supported pop-up elements upwardly from the plane of the pages.

U.S. Pat. No. 4,349,973 issued to Penick et al. sets forth POP-UPS AND METHODS OF MAKING capable of fabrication by mechanical mass production particularly as a part of a web press operation. A pair of pop-up elements in the form of two panels are attached to one another preferably by an adhesive and are interconnected by hinges to base pieces which constitute halves of a folder.

U.S. Pat. No. 5,049,078 issued to Thomsen sets forth an PICTURE BOOK WITH PLAY EFFECT having a plurality of toy elements with modularly dimensioned coupling means. The toy elements may be placed on a picture plane provided with correspondingly dimensioned positioning recesses or elevations. A child may play with the toy elements to arrange a three dimensional representation of the situation described in the story text.

U.S. Pat. No. 5,213,507 issued to Ozrovitz sets forth an INSTRUCTIONAL CHILD'S STORY AND PICTURE BOOK including a front cover, a back cover and a plurality of pages pivotally disposed between the covers. At least one of the pages includes text on one or more sides and a puzzle on the other side. The puzzle includes a plurality of interlocking puzzle pieces which provide hand and eye coordination and recognition skill development for children.

U.S. Pat. No. 5,293,706 issued to Wood sets forth an MULTIPLE-IMAGE DISPLAY DEVICE having a folded card like promotional display device which includes first and second panels pivotally movable between a closed condition and a relatively open condition. The device includes a third panel located between and depending from the first and second panels. A first image carried on a first face of the third panel is viewable in the closed condition of the device through a window defined in the first panel.

U.S. Pat. No. 5,681,199 issued to Morris sets forth a BOOK HAVING A POP-UP TOY in which a binder supports a plurality of pages and defines a generally cylindrical member. A pop-up toy is resiliently supported within the binder and is spring loaded to rise abruptly when released.

U.S. Pat. No. 5,104,124 issued to Bernard et al. sets forth a COLLAPSIBLE GAME USEABLE AS A PROMOTIONAL DEVICE having a game supported within a case and defining a plurality of panels which fold outwardly to form a simulated basketball backboard and underlying court.

U.S. Pat. No. 5,562,520 issued to Pridonoff et al. sets forth a collapsible structure forming a three dimensional self supporting play and amusement stage for a child.

U.S. Pat. No. 5,096,204 issued to Lippman sets forth a THREE-DIMENSIONAL BOOK OR GAME BOARD STRUCTURE configurable in either an open or closed configuration. The game board is fabricated of a plurality of individual leaves in which the leaves have substantial thickness and in which the outline shape of any individual leaf is defined in essentially two dimensions. The two dimensional shape or size of the leaves varies from one leaf to another such that the closed book assumes the form of a distinct three dimensional structure having a recognizable shape. The leaves are capable of lying in a single plane when unfolded.

While the foregoing described prior art devices have improved the art and in some instances enjoyed commercial success, there remains nonetheless a continuing need in the art for ever more improved, interesting and amusing board game apparatus.

SUMMARY OF THE INVENTION

Accordingly, it is a general object of the present invention to provide an improved board game. It is a more particular object of the present invention to provide an improved board game which includes a foldable board and which assumes a three dimensional character when unfolded. It is a still more particular object of the present invention to provide an improved board game in which the folding board is convenient for storage and carrying of game apparatus therein.

In accordance with the present invention there is provided a board game comprising: a folding game board having a plurality of generally planar board segments and a plurality of hinges joining each board segment to its adjacent board segment, the game board being unfoldable to an open play configuration and foldable to a generally rectangular closed configuration; a plurality of pop-up features supported on the game board having collapsed positions and risen portions; a plurality of game play objects; and a box secured to the game board having an interior cavity for receiving the game play objects for storage.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

DESCRIPTION OF THE PREFERRED EMBODIMENT

Figure 1:
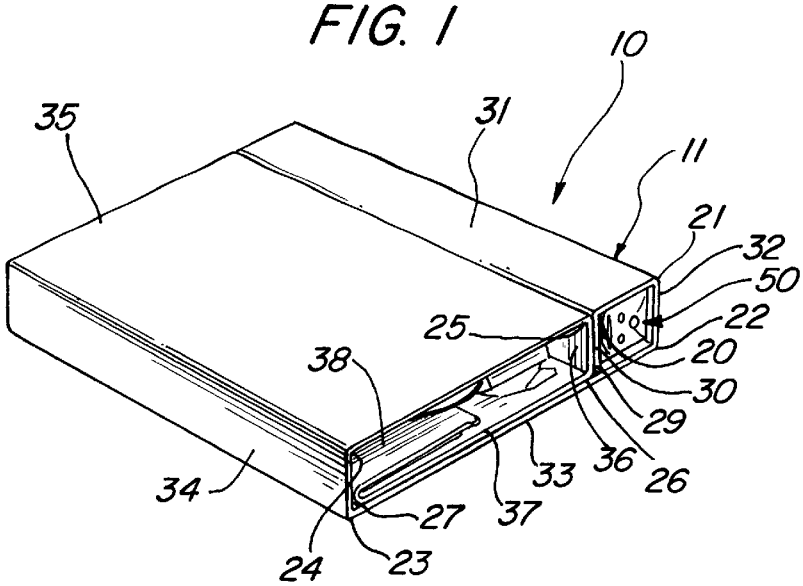
FIG. 1 sets forth perspective view of the present invention folding game board in its closed configuration.

FIG. 1 sets forth a perspective view of a folding board game constructed in accordance with the present invention and generally referenced by numeral 10. Board game 10 is shown in its folded or closed configuration in FIG. 1. In accordance with an important aspect of the present invention the folded configuration of board game 10 results in a very tight closely compacted configuration suitable for storage or carrying. Board game 10 includes a multi-segment multiply hinged folding board 11 preferably fabricated of a relatively rigid material such as heavy cardboard, particle board or molded plastic. Folding board 11 defines a plurality of generally planar board segments 30, 31, 32, 33, 34, 35, 36, 37 and 38. A corresponding plurality of hinges join each adjacent segment to facilitate the folding action of folding board 11. Thus, hinge 20 joins segments 30 and 31 while hinge 21 joins segments 31 and 32 and hinge 22 joins segments 32 and 33. Similarly, hinge 23 joins segments 33 and 34 while hinge 24 joins segments 34 and 35. Hinge 25 joins segments 35 and 36, hinge 26 joins segments 36 and 37 and finally hinge 27 joins segments 37 and 38. A generally rectangular box 50 is secured to segment 30 in the manner set forth below and is captivated between segments 30, 31 and 32 and forms one end of board game 10 in its folded configuration. The remaining end of board game 10 is formed by the right angle relationships of segments 33, 34 and 35.

Figure 2:
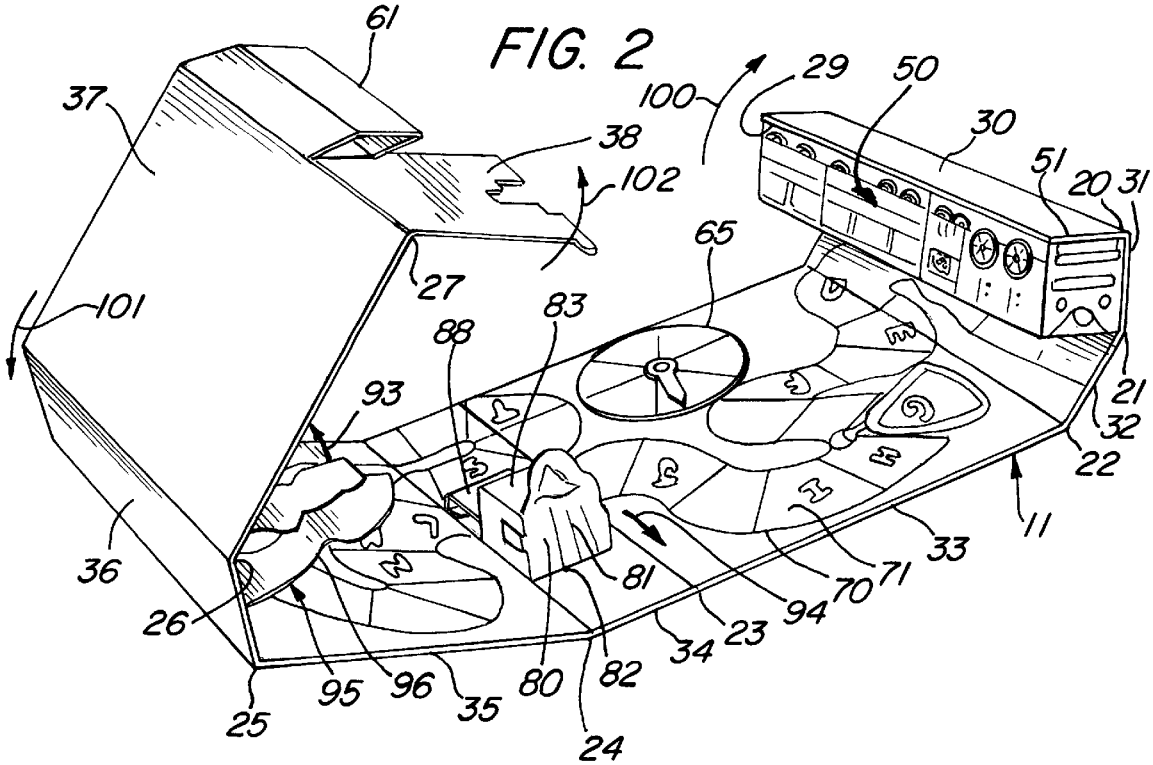
FIG. 2 sets forth a perspective view of the present invention game at an intermediate point in the unfolding process.

FIG. 2 sets forth a perspective view of board game 10 at an intermediate point in the unfolding or opening of folding board 11 from its compact or closed position shown in FIG. 1. Thus, the various segments of folding board 11 are shown pivoting and turning outwardly to unfold folding board 11 toward the fully open position shown in FIG. 3.

More specifically, folding board 11 includes a plurality of generally planar board segments 30 through 38 having each adjacent segment pair joined by a hinge. Thus, folding board 11 defines hinges 20 through 27 providing the folding capability of the present invention. More specifically, segments 30 and 31 are joined by hinge 20 while segments 31 and 32 are joined by hinge 21 and segments 32 and 33 are joined by hinge 22. Further hinge 23 joins segments 33 and 34 while hinge 24 joins segments 34 and 35. Hinge 25 joins segments 35 and 36 while segments 36 and 37 are joined by hinge 26 and segments 37 and 38 are joined by hinge 27.

Board game 10 further includes a generally rectangular box 50 having a bottom surface 51 secured to segment 30 along edge 29 thereof by a conventional attachment such as adhesive attachment or the like. Folding board 11 further defines a number of images printed thereon including a multiply curved pathway 70 divided into a plurality of spaces 71. A chance device 65 is supported upon folding board 11 at a convenient point at pathway 70.

In accordance with an important aspect of the present invention, a plurality of pop-up features such as pop-up features 80 and 95 are supported upon the interior surface of folding board 11. The pop-up features of the present invention board game may be fabricated entirely in accordance with conventional fabrication techniques such as those described above in the Background of the Invention. For purposes of illustration, pop-up 80 is shown having a riser 81 joined to segment 34 at a hinge 82 together with a pop-up box 83 and a pop-up step 88 all joined hingedly to segment 34 in the manner shown in FIG. 3. Similarly, pop-up feature 95 is joined to segments 35, 36 and 37 and is fabricated in accordance with conventional fabrication techniques. Thus, pop-up 95 includes riser segments 96 and 97 and is configured to fold along hinges 25 and 26. Once again it must be emphasized, that pop-ups 80 and 95 are merely representative of the virtually endless variety of pop-up features well known in the art and frequently in use in books and greeting cards as described above. An additional pop-up feature 61 forms a box-like structure joined to segment 38 and folds in a parallelogram type folding action and thus is configurable in either a collapsed parallelogram as shown in FIG. 2 or as a generally rectangular prism as shown in FIG. 3.

During the unfolding process shown in FIG. 2, the various segments of folding board 11 are pivoting outwardly in the general directions indicated by arrows 100, 101 and 102. Correspondingly, pop-up features 80 and 95 are rising from the supporting surface of folding board 11 in the general directions indicated by arrows 94 and 93 respectively. Thus, as folding board 11 is unfolded from the closed configuration shown in FIG. 1 toward the open configuration shown in FIG. 3, the various pop-up features and other features such as box 50 are moved as the board segments pivot about their respective hinges and as folding board 11 unfolds.

Figure 3:
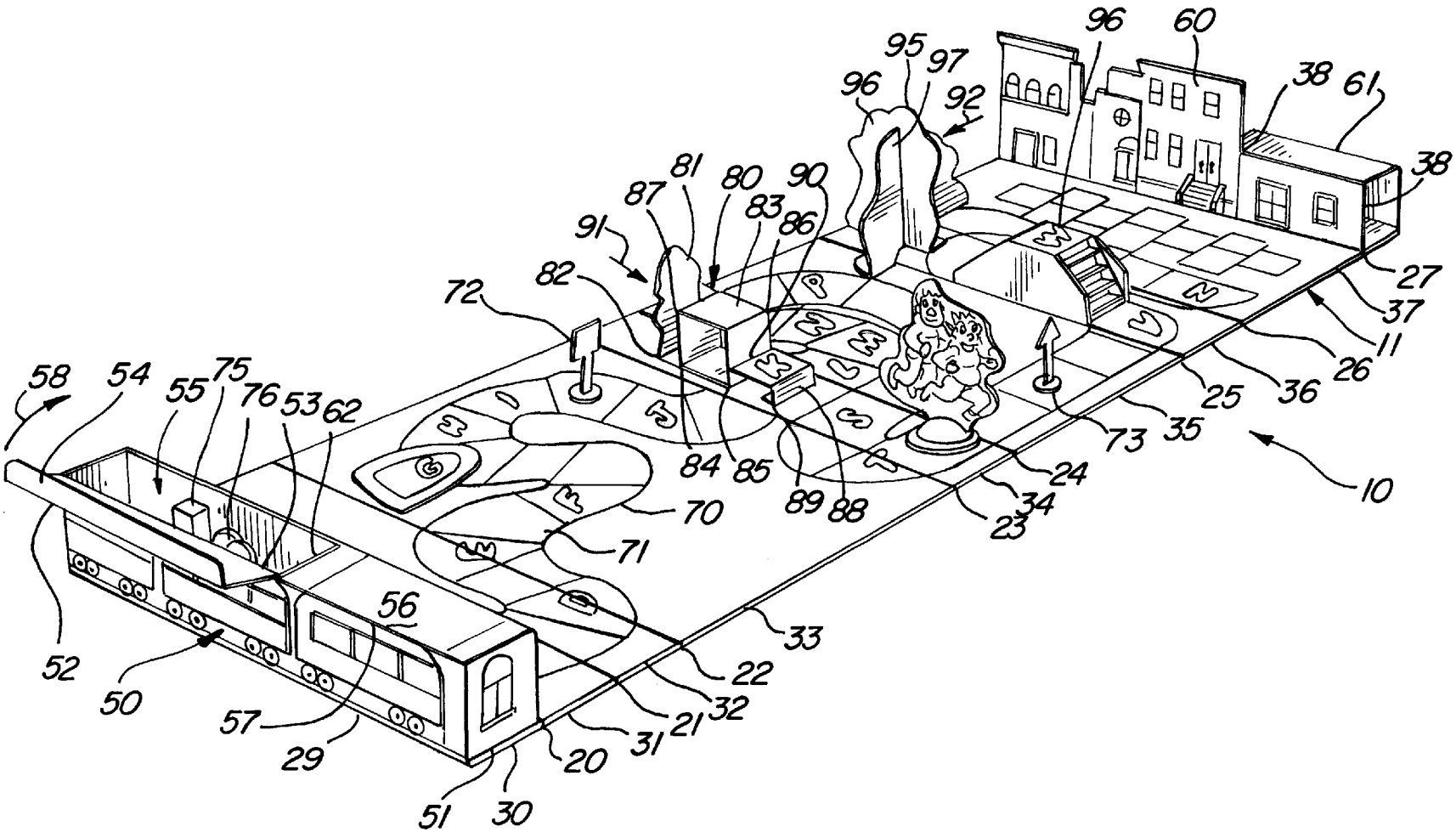
FIG. 3 sets forth a perspective view of the present invention board game having the game board fully unfolded.

FIG. 3 sets forth a perspective view of the present invention board game in its normal play position accomplished by fully opening folding board 11. Thus as described above, folding board 11 is formed of a plurality of generally planar board segments 30 through 38 joined in adjacent pairs by respective hinges 20 though 27. The upper surface of folding board 11 defines a number of images including a multiply curved pathway 70 divided into a plurality of spaces 71. Box 50 which defines a generally rectangular shape includes a bottom surface 51 secured to segment 30 and aligned with edge 29. In the preferred fabrication of the present invention, bottom 51 of box 50 is secured to segment 30 using conventional attachment means such as adhesive attachment or the like. In further accordance with the preferred fabrication of the present invention, box 50 provides a convenient storage receptacle for the various play pieces which would otherwise be loose and difficult to contain in the folded configuration of FIG. 1. Accordingly, box 50 is divided into a pair of internal cavities by a partition 62. The number of cavities formed in box 50 is subject to convenience in accommodating the number and size of the various game play elements being utilized in playing board game 10. In the embodiment shown in FIG. 3, box 50 is divided into two interior cavities such as interior cavity 55. Correspondingly, box 50 defines a pair of lids 52 and 56 joined to the remainder of box 50 by respective hinges 53 and 57. Lid 52 defines a lock tab 54 and is pivoted in the direction indicated by arrow 58 to provide closure of interior cavity 55. For purposes of illustration, tokens 75 and 76 are shown stored within interior cavity 55. Thus, in accordance with the present invention, a plurality of loose play pieces such as tokens 72 though 76 may be stored within box 50 for convenience and to avoid loosing the token pieces. Other elements if included in the game play objects of game board 10 may likewise be stored in box 50.

In further accordance with an important aspect of the present invention, board game 10 includes a plurality of pop-up features such as pop-up features 80 and 95. Board game 10 further includes a folding pop-up feature 61. Pop-up features 80, 95 and 61 are set forth for purposes of example or illustration and not limitation. A variety of pop-up elements and features are well known in the art and may readily be utilized in combination with the present invention board game. Pop-up 80 includes a riser 81 joined to segment 34 of folding board 11 by a hinge 82. Pop-up feature 80 further includes a pop-up box 83 joined by a plurality of hinges 84 though 87 to form a collapsing parallelogram. Further, pop-up feature 80 includes a step pop-up 88 joined by hinges 89 and 90 to segment 34 and box 83 respectively. During the folding operation, pop-up feature 80 pivots or "collapses" in the direction indicated by arrow 91 to form a flat structure upon segment 34.

Pop-up 95 includes a pair of segments 96 and 97 which are supported to provide folding or collapse of pop-up feature 95 in the direction indicated by arrow 92. Pop-up feature 95 folds to accommodate the size of segment 36 of folding board 11.

Pop-up feature 61 defines a collapsing parallelogram which as described above in FIG. 2 may be folded to form a generally flat parallelogram as shown in FIG. 2 or unfolded to the generally rectangular configuration shown in FIG. 3. To further enhance the attractiveness of board game 10, segment 38 is supported about hinge 27 by pop-up box 61 in a right angle relationship to segment 37. Further, segment 38 defines a decorative facade 60 to further enhance the visual appeal of board game 10. A step obstacle 96 is supported upon segment 36 of folding board 11. Step obstacle 96 is illustrative of features which may be supported upon board game 10 which are not pop-up features in their fabrication. Thus, pop-up features and fixed configuration features such as step obstacle 96 may be accommodated by the structure of folding board 11.

In accordance with the anticipated play of game 10, tokens 72, 73 and 74 are shown at various positions along pathway 70. In one form of game play using board game 10, it is anticipated that game rules will be play out which result in progressive movement of the players tokens upon pathway 70. At the completion of game play board game 10 may be reconfigured to its closed or folded configuration shown in FIG. 1 by essentially reversing the unfolding procedure described above in FIG. 2. Thus, the various loose items such as tokens 72, 73 and 74 may be conveniently stored within box 50 and lids 52 and 56 closed. Thereafter, the folding procedure is carried forward as box 50 is pivoted successively inwardly about hinges 20, 21 and 22 to the position shown in FIG. 1. Correspondingly, segment 38 is pivoted about hinge 27 to overlie segment 37 and thereafter segments 35, 36 and 37 are pivoted to form the generally rectangular configuration shown in FIG. 1. Finally, the rectangle formed by segments 35, 36 and 37 is pivoted about hinges 23 and 24 to position segment 36 against segment 30 and complete the closure to the configuration shown in FIG. 1. At this point board game 10 is completely closed and may be conveniently stored or transported.

While particular embodiments of the invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention.

That which is claimed is:

1. A board game comprising:

a folding game board having a plurality of generally planar board segments and a plurality of hinges joining each board segment to its adjacent board segment, said game board being unfoldable to an open play configuration defining a game play surface having a game pathway formed of a plurality of spaces upon said same play surface and said same board being foldable to a generally rectangular closed configuration;

a plurality of pop-up features supported on said game board within said game pathway, said pop-up features having collapsed positions and risen portions;

a plurality of game play objects each moved by a player along said game pathway; and a box secured to said game board having an interior cavity for receiving said game play objects for storage.

2. The board game set forth in claim 1 wherein said game pathway includes at least one of said spaces is formed on one of said pop-up features and wherein said plurality of board segments includes a pair of end segments and wherein one of said end segments is a facade segment and is generally perpendicular to its adjacent segment in open play configuration.

3. The board game set forth in claim 2 wherein said box is secured to the remaining one of said pair of end segments.

4. The board game set forth in claim 3 wherein said box is generally rectangular.

5. The board game set forth in claim 4 wherein said plurality of pop-up features includes a generally rectangular member forming a generally right angle prism when said game board is in said open configuration supporting said facade segment and forming a substantially collapsed parallelogram when said game board is in its closed configuration.

6. The board game set forth in claim 1 wherein said plurality of board segments includes a pair of end segments and wherein said box is secured to one of said end segments.

7. The board game set forth in claim 6 wherein said box is generally rectangular.

* * * * *